US009556811B2

(12) United States Patent
Wagh et al.

(10) Patent No.: US 9,556,811 B2
(45) Date of Patent: Jan. 31, 2017

(54) FIRING PATTERN MANAGEMENT FOR IMPROVED TRANSIENT VIBRATION IN VARIABLE CYLINDER DEACTIVATION MODE

(71) Applicant: GM Global Technology Operations LLC, Detroit, MI (US)

(72) Inventors: Nitish J. Wagh, Northville, MI (US); Randall S. Beikmann, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 188 days.

(21) Appl. No.: 14/310,063

(22) Filed: Jun. 20, 2014

(65) Prior Publication Data

US 2015/0369140 A1 Dec. 24, 2015

(51) Int. Cl.

*F02D 41/00* (2006.01)
*F02D 17/02* (2006.01)
*F02D 13/06* (2006.01)

(52) U.S. Cl.

CPC ..... *F02D 41/0087* (2013.01); *F02D 13/06* (2013.01); *F02D 17/02* (2013.01); *F02D 41/008* (2013.01)

(58) Field of Classification Search

CPC ..... F02D 41/008; F02D 41/0087; F02D 2041/0012; F02D 17/00; F02D 17/02; F02D 13/06; F01D 17/00; F01D 17/02; G01M 15/12

USPC ..... 123/198 DB, 198 DC, 198 F, 481; 701/103–105

See application file for complete search history.

(56) References Cited

U.S. PATENT DOCUMENTS

| | | | |
|---|---|---|---|
| 3,596,640 | A | 8/1971 | Bloomfield |
| 4,129,034 | A | 12/1978 | Niles et al. |
| 4,172,434 | A | 10/1979 | Coles |
| 4,377,997 | A | 3/1983 | Staerzl |

(Continued)

FOREIGN PATENT DOCUMENTS

| | | | |
|---|---|---|---|
| CN | 1573916 | A | 2/2005 |
| CN | 1888407 | A | 1/2007 |

(Continued)

OTHER PUBLICATIONS

International Search Report and Written Opinion dated Jun. 17, 2015 corresponding to International Application No. PCT/US2015/019496, 14 pages.

(Continued)

*Primary Examiner* — Lindsay Low
*Assistant Examiner* — Robert Werner

(57) ABSTRACT

A system includes a cylinder control module that determines target numbers of cylinders of an engine to be activated during a period, determines, based on the target numbers and an engine speed, N predetermined sequences for controlling the cylinders of the engine during the period, determines whether a transition parameter is associated with at least one of the N predetermined subsequences and selectively adjusts at least one of the N predetermined subsequences based on the determination of whether a transition parameter is associated with at least two of the N predetermined sequences. The system further includes a cylinder actuator module that, during the period, controls the cylinders of the engine based on the N predetermined sequence and based on the at least one selectively adjusted predetermined sequences.

14 Claims, 4 Drawing Sheets

(56) References Cited

U.S. PATENT DOCUMENTS 4,434,767 A 3/1984 Kohama et al.
4,489,695 A 12/1984 Kohama et al.
4,509,488 A 4/1985 Forster et al.
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A 1/1991 Funabashi et al.
5,042,444 A 8/1991 Hayes et al.
5,094,213 A 3/1992 Dudek et al.
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,496,227 A 3/1996 Minowa et al.
5,540,633 A 7/1996 Yamanaka et al.
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,778,858 A * 7/1998 Garabedian ..... F02D 41/1443 123/481
5,813,383 A 9/1998 Cummings
5,884,605 A 3/1999 Nagaishi et al.
5,909,720 A 6/1999 Yamaoka et al.
5,931,140 A 8/1999 Maloney
5,934,263 A 8/1999 Russ et al.
5,941,927 A 8/1999 Pfitz
5,974,870 A 11/1999 Treinies et al.
5,975,052 A 11/1999 Moyer
5,983,867 A 11/1999 Stuber et al.
6,125,812 A 10/2000 Garabedian
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 3/2002 Suhre et al.
6,363,316 B1 3/2002 Soliman et al.
6,371,075 B2 4/2002 Koch
6,385,521 B1 5/2002 Ito
6,408,625 B1 6/2002 Woon et al.
6,520,140 B2 2/2003 Dreymuller et al.
6,546,912 B2 4/2003 Tuken
6,588,261 B1 7/2003 Wild et al.
6,619,258 B2 9/2003 McKay et al.
6,622,548 B1 9/2003 Hernandez
6,694,806 B2 2/2004 Kumagai et al.
6,738,707 B2 5/2004 Kotwicki et al.
6,754,577 B2 6/2004 Gross et al.
6,760,656 B2 7/2004 Matthews et al.
6,850,831 B2 2/2005 Buckland et al.
6,909,961 B2 6/2005 Wild et al.
6,978,204 B2 12/2005 Surnilla et al.
6,980,902 B2 12/2005 Nakazawa
6,981,492 B2 1/2006 Barba et al.
6,983,737 B2 1/2006 Gross et al.
7,003,390 B2 2/2006 Kaga
7,024,301 B1 4/2006 Kar et al.
7,025,041 B2 4/2006 Abe et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,066,136 B2 6/2006 Ogiso
7,069,718 B2 7/2006 Surnilla et al.
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,159,568 B1 1/2007 Lewis et al.
7,174,713 B2 2/2007 Nitzke et al.
7,174,879 B1 2/2007 Chol et al.
7,200,486 B2 4/2007 Tanaka et al.
7,203,588 B2 4/2007 Kaneko et al.
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,367,318 B2 5/2008 Moriya et al.
7,415,345 B2 8/2008 Wild
7,440,838 B2 10/2008 Livshiz et al.
7,464,676 B2 12/2008 Wiggins et al.
7,472,014 B1 12/2008 Albertson et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,555,896 B2 7/2009 Lewis et al.
7,577,511 B1 8/2009 Tripathi et al.
7,581,531 B2 9/2009 Schulz
7,614,384 B2 11/2009 Livshiz et al.
7,620,188 B2 11/2009 Inoue et al.
7,621,262 B2 11/2009 Zubeck
7,634,349 B2 12/2009 Senft et al.
7,685,976 B2 3/2010 Marriott
7,785,230 B2 8/2010 Gibson et al.
7,836,866 B2 11/2010 Luken et al.
7,849,835 B2 12/2010 Tripathi et al.
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 9/2012 Shikama et al.
8,347,856 B2 1/2013 Leone et al.
8,402,942 B2 * 3/2013 Tripathi ..... F02D 41/0087 123/198 F
8,473,179 B2 6/2013 Whitney et al.
8,616,181 B2 12/2013 Sahandiesfanjani et al.
8,646,430 B2 2/2014 Kinoshita
8,646,435 B2 * 2/2014 Dibble ..... F02D 41/0087 123/198 DB
8,701,628 B2 4/2014 Tripathi et al.
8,706,383 B2 4/2014 Sauve et al.
8,833,058 B2 9/2014 Ervin et al.
8,833,345 B2 9/2014 Pochner et al.
8,869,773 B2 10/2014 Tripathi et al.
8,979,708 B2 3/2015 Burtch
9,020,735 B2 * 4/2015 Tripathi ..... F02D 41/0087 701/102
9,140,622 B2 9/2015 Beikmann
9,200,575 B2 * 12/2015 Shost ..... F02D 17/02
9,212,610 B2 * 12/2015 Chen ..... F02D 41/0082
9,222,427 B2 12/2015 Matthews et al.
2001/0007964 A1 7/2001 Poljansek et al.
2002/0038654 A1 4/2002 Sasaki et al.
2002/0039950 A1 4/2002 Graf et al.
2002/0156568 A1 10/2002 Knott et al.
2002/0162540 A1 11/2002 Matthews et al.
2002/0189574 A1 12/2002 Kim
2003/0116130 A1 6/2003 Kisaka et al.
2003/0123467 A1 7/2003 Du et al.
2003/0131820 A1 7/2003 Mckay et al.

(56) References Cited

U.S. PATENT DOCUMENTS

2003/0172900 A1 9/2003 Boyer et al.
2004/0007211 A1 1/2004 Kobayashi
2004/0034460 A1 2/2004 Folkerts et al.
2004/0069290 A1 4/2004 Bucktron et al.
2004/0122584 A1 6/2004 Muto et al.
2004/0129249 A1 7/2004 Kondo
2004/0138027 A1 7/2004 Rustige et al.
2004/0206072 A1 10/2004 Surnilla et al.
2004/0258251 A1 12/2004 Inoue et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2006/0112918 A1 6/2006 Persson
2006/0130814 A1 6/2006 Bolander et al.
2006/0178802 A1 8/2006 Bolander et al.
2007/0012040 A1 1/2007 Nitzke et al.
2007/0042861 A1 2/2007 Takaoka et al.
2007/0051351 A1 3/2007 Pallett et al.
2007/0100534 A1 5/2007 Katsumata
2007/0101969 A1 5/2007 Lay et al.
2007/0107692 A1 5/2007 Kuo et al.
2007/0131169 A1 6/2007 Ahn
2007/0131196 A1 6/2007 Gibson et al.
2007/0135988 A1 6/2007 Kidston et al.
2007/0235005 A1 10/2007 Lewis
2008/0000149 A1 1/2008 Aradi
2008/0041327 A1 2/2008 Lewis et al.
2008/0066699 A1 3/2008 Michelini et al.
2008/0098969 A1 5/2008 Reed et al.
2008/0109151 A1 5/2008 Jaros et al.
2008/0121211 A1 5/2008 Livshiz et al.
2008/0154468 A1 6/2008 Berger et al.
2008/0254926 A1 10/2008 Schuseil et al.
2008/0262698 A1 10/2008 Lahti et al.
2008/0288146 A1 11/2008 Beechie et al.
2009/0007877 A1 1/2009 Raiford
2009/0013667 A1 1/2009 Winstead
2009/0013668 A1 1/2009 Winstead
2009/0013669 A1 1/2009 Winstead
2009/0013969 A1 1/2009 Winstead
2009/0018746 A1 1/2009 Miller et al.
2009/0030594 A1 1/2009 You et al.
2009/0042458 A1 2/2009 Kinoshita
2009/0042463 A1 2/2009 Kinoshita
2009/0118914 A1 5/2009 Schwenke et al.
2009/0118965 A1 5/2009 Livshiz et al.
2009/0118968 A1 5/2009 Livshiz et al.
2009/0118975 A1 5/2009 Murakami et al.
2009/0118986 A1 5/2009 Kita
2009/0177371 A1 7/2009 Reinke
2009/0204312 A1 8/2009 Moriya
2009/0229562 A1 9/2009 Ramappan et al.
2009/0241872 A1 10/2009 Wang et al.
2009/0248277 A1 10/2009 Shinagawa et al.
2009/0248278 A1 10/2009 Nakasaka
2009/0292435 A1 11/2009 Costin et al.
2010/0006065 A1 1/2010 Tripathi et al.
2010/0010724 A1 1/2010 Tripathi et al.
2010/0012072 A1 1/2010 Leone et al.
2010/0030447 A1 2/2010 Smyth et al.
2010/0036571 A1 2/2010 Han et al.
2010/0042308 A1 2/2010 Kobayashi et al.
2010/0050993 A1 3/2010 Zhao et al.
2010/0057283 A1 3/2010 Worthing et al.
2010/0059004 A1 3/2010 Gill
2010/0100299 A1 4/2010 Tripathi et al.
2010/0107630 A1 5/2010 Hamama et al.
2010/0211299 A1 8/2010 Lewis et al.
2010/0222989 A1 9/2010 Nishimura
2010/0282202 A1 11/2010 Luken
2010/0318275 A1 12/2010 Borchsenius et al.
2011/0005496 A1 1/2011 Hiraya et al.
2011/0030657 A1 2/2011 Tripathi et al.
2011/0048372 A1 3/2011 Dibble et al.
2011/0088661 A1 4/2011 Sczomak et al.
2011/0094475 A1 4/2011 Riegel et al.
2011/0107986 A1 5/2011 Winstead
2011/0118955 A1 5/2011 Livshiz et al.
2011/0144883 A1 6/2011 Rollinger et al.
2011/0178693 A1 7/2011 Chang et al.
2011/0208405 A1 8/2011 Tripathi et al.
2011/0213526 A1 9/2011 Giles et al.
2011/0213540 A1 9/2011 Tripathi et al.
2011/0213541 A1 9/2011 Tripathi et al.
2011/0251773 A1 10/2011 Sahandiesfanjani et al.
2011/0264342 A1 10/2011 Baur et al.
2011/0265454 A1 11/2011 Smith et al.
2011/0265771 A1 11/2011 Banker et al.
2011/0295483 A1 12/2011 Ma et al.
2011/0313643 A1 12/2011 Lucatello et al.
2012/0029787 A1 2/2012 Whitney et al.
2012/0055444 A1 3/2012 Tobergte et al.
2012/0103312 A1 5/2012 Sasai et al.
2012/0109495 A1 5/2012 Tripathi et al.
2012/0116647 A1 5/2012 Pochner et al.
2012/0143471 A1 6/2012 Tripathi et al.
2012/0180759 A1 7/2012 Whitney et al.
2012/0221217 A1 8/2012 Sujan et al.
2012/0285161 A1 11/2012 Kerns et al.
2013/0092127 A1 4/2013 Pirjaberi et al.
2013/0092128 A1 4/2013 Pirjaberi et al.
2013/0184949 A1 7/2013 Saito et al.
2013/0289853 A1 10/2013 Serrano
2014/0041625 A1 2/2014 Pirjaberi et al.
2014/0041641 A1 2/2014 Carlson et al.
2014/0053802 A1 2/2014 Rayl
2014/0053803 A1 2/2014 Rayl
2014/0053804 A1 2/2014 Rayl et al.
2014/0053805 A1 2/2014 Brennan et al.
2014/0069178 A1 3/2014 Beikmann
2014/0069374 A1 3/2014 Matthews
2014/0069375 A1 3/2014 Matthews et al.
2014/0069376 A1 3/2014 Matthews et al.
2014/0069377 A1 3/2014 Brennan et al.
2014/0069378 A1 3/2014 Burleigh et al.
2014/0069379 A1 3/2014 Beikmann
2014/0069381 A1 3/2014 Beikmann
2014/0090623 A1* 4/2014 Beikmann ..... F02D 41/0087 123/350
2014/0090624 A1 4/2014 Verner
2014/0102411 A1 4/2014 Brennan
2014/0190448 A1 7/2014 Brennan et al.
2014/0190449 A1 7/2014 Phillips
2014/0194247 A1 7/2014 Burtch
2014/0207359 A1 7/2014 Phillips
2015/0240671 A1 8/2015 Nakamura
2015/0260112 A1 9/2015 Liu et al.
2015/0260117 A1 9/2015 Shost et al.
2015/0354470 A1 12/2015 Li et al.
2015/0361907 A1 12/2015 Hayman et al.

FOREIGN PATENT DOCUMENTS

CN 101220780 A 7/2008
CN 101353992 A 1/2009
CN 101476507 A 7/2009
CN 101586504 A 11/2009
CN 102454493 A 5/2012
EP 1489595 A2 12/2004
JP 2010223019 A 10/2010
JP 2011149352 A 8/2011

(56) References Cited

FOREIGN PATENT DOCUMENTS

OTHER PUBLICATIONS

U.S. Appl. No. 13/798,384, filed Mar. 13, 2013, Burtch.
U.S. Appl. No. 13/798,518, filed Mar. 13, 2013, Beikmann.
U.S. Appl. No. 13/798,624, filed Mar. 13, 2013, Brennan et al.
U.S. Appl. No. 13/799,181, filed Mar. 13, 2013, Beikmann.
U.S. Appl. No. 61/952,737, filed Mar. 13, 2014, Shost et al.
Glossary of Judicial Claim Constructions in the Electronics, Computer and Business Method Arts. Public Patent Foundation. (2010).
U.S. Appl. No. 13/798,351, filed Mar. 13, 2013, Rayl.
U.S. Appl. No. 13/798,400, filed Mar. 13, 2013, Phillips.
U.S. Appl. No. 13/798,435, filed Mar. 13, 2013, Matthews.
U.S. Appl. No. 13/798,451, filed Mar. 13, 2013, Rayl.
U.S. Appl. No. 13/798,471, filed Mar. 13, 2013, Matthews et al.
U.S. Appl. No. 13/798,536, filed Mar. 13, 2013, Matthews et al.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,701, filed Mar. 13, 2013, Burleigh et al.
U.S. Appl. No. 13/798,737, filed Mar. 13, 2013, Beikmann.
U.S. Appl. No. 13/798,775, filed Mar. 13, 2013, Phillips.
U.S. Appl. No. 13/799,116, filed Mar. 13, 2013, Brennan.
U.S. Appl. No. 13/799,129, filed Mar. 13, 2013, Beikmann.
U.S. Appl. No. 14/143,267, filed Dec. 30, 2013, Gehringer et al.
U.S. Appl. No. 14/211,389, filed Mar. 14, 2014, Liu et al.
U.S. Appl. No. 14/300,469, filed Jun. 10, 2014, Li et al.
U.S. Appl. No. 14/449,726, filed Aug. 1, 2014, Hayman et al.
U.S. Appl. No. 14/548,501, filed Nov. 20, 2014, Beikmann et al.
U.S. Appl. No. 14/638,908, filed Mar. 4, 2015, Shost et al.
U.S. Appl. No. 14/734,619, filed Jun. 9, 2015, Matthews.

* cited by examiner

FIRING PATTERN MANAGEMENT FOR IMPROVED TRANSIENT VIBRATION IN VARIABLE CYLINDER DEACTIVATION MODE

FIELD

The present disclosure relates to internal combustion engines and more specifically to engine control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Under some circumstances, one or more cylinders of an engine may be deactivated. Deactivation of a cylinder may include deactivating opening and closing of intake valves of the cylinder and halting fueling of the cylinder. One or more cylinders may be deactivated, for example, to decrease fuel consumption when the engine can produce a requested amount of torque while the one or more cylinders are deactivated.

SUMMARY

A system includes a cylinder control module that determines target numbers of cylinders of an engine to be activated during a period, determines, based on the target numbers and an engine speed, N predetermined sequences for controlling the cylinders of the engine during the period, determines whether a transition parameter is associated with at least one of the N predetermined subsequences and selectively adjusts at least one of the N predetermined subsequences based on the determination of whether a transition parameter is associated with at least two of the N predetermined subsequences. The system further includes a cylinder actuator module that, during the period, controls the cylinders of the engine based on the N predetermined subsequences and based on the at least one selectively adjusted predetermined subsequences.

In other features, cylinder control method includes: determining target numbers of cylinders of an engine to be activated during a period, determining, based on the target numbers and an engine speed, N predetermined subsequences for controlling cylinders of the engine during the period, determining whether a transition parameter is associated with at least one transition between two of the N predetermine subsequences, selectively adjusting at least one of the N predetermine sequences based on the determination a transition parameter is associated with at least two of the N predetermine sequences s, and controlling, during the period, the cylinders of the engine based on the N predetermined sequences.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption when the engine can produce a requested amount of torque while the one or more cylinders are deactivated. Deactivation of one or more cylinders, however, may increase powertrain-induced vibration relative to the activation of all of the cylinders.

The ECM of the present disclosure determines an average number of cylinders per sub-period to be activated during a future period including a plurality of sub-periods. Based on achieving the average number of cylinders over the future period, the ECM generates a first sequence indicating N target numbers of cylinders to be activated during the each of the plurality of sub-periods, respectively. N is an integer greater than or equal to 1. The ECM generates a second sequence indicating one or more predetermined subsequences for activating and deactivating cylinders to achieve the N target numbers of activated cylinders during each of the sub-periods, respectively. The predetermined subsequences are selected to smooth torque production and delivery, minimize harmonic vehicle vibration, minimize impulsive vibration characteristics, and minimize induction and exhaust noise.

The ECM generates a target sequence for activating and deactivating cylinders of the engine during the future period based on the predetermined subsequences. The cylinders are activated and deactivated based on the target sequence during the future period. More specifically, the cylinders are activated and deactivated based on the predetermined subsequences during each of the sub-periods, respectively. In some instances, the ECM may adjust one or more of the selected subsequences in order to reduce vibration during transition between one or more of the selected subsequences. Deactivation of a cylinder may include deactivating opening and closing of intake valves of the cylinder and halting fueling of the cylinder.

Figure 1:
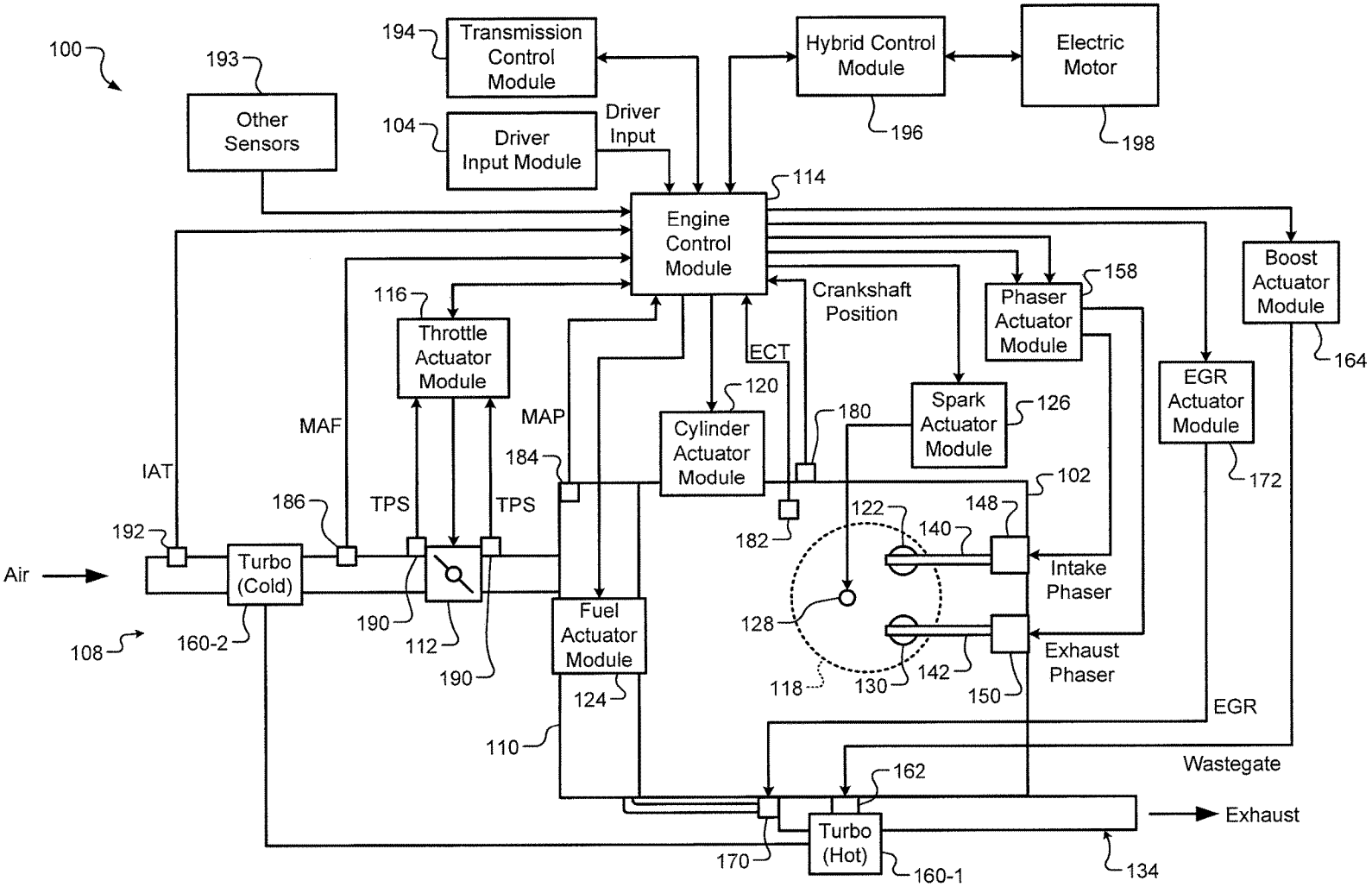
FIG. 1 is a functional block diagram of an example engine system according to the present disclosure.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle. The four strokes, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to a transmission (not shown) via the crankshaft. One or more coupling devices, such as a torque converter and/or one or more clutches, regulate torque transfer between a transmission input shaft and the crankshaft. Torque is transferred between the transmission input shaft and a transmission output shaft via the gears.

Torque is transferred between the transmission output shaft and wheels of the vehicle via one or more differentials, driveshafts, etc. Wheels that receive torque output by the transmission may be referred to as driven wheels. Wheels that do not receive torque from the transmission may be referred to as undriven wheels.

The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Each system that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may control the actuator values in order to cause the engine 102 to generate a desired engine output torque.

Figure 2:
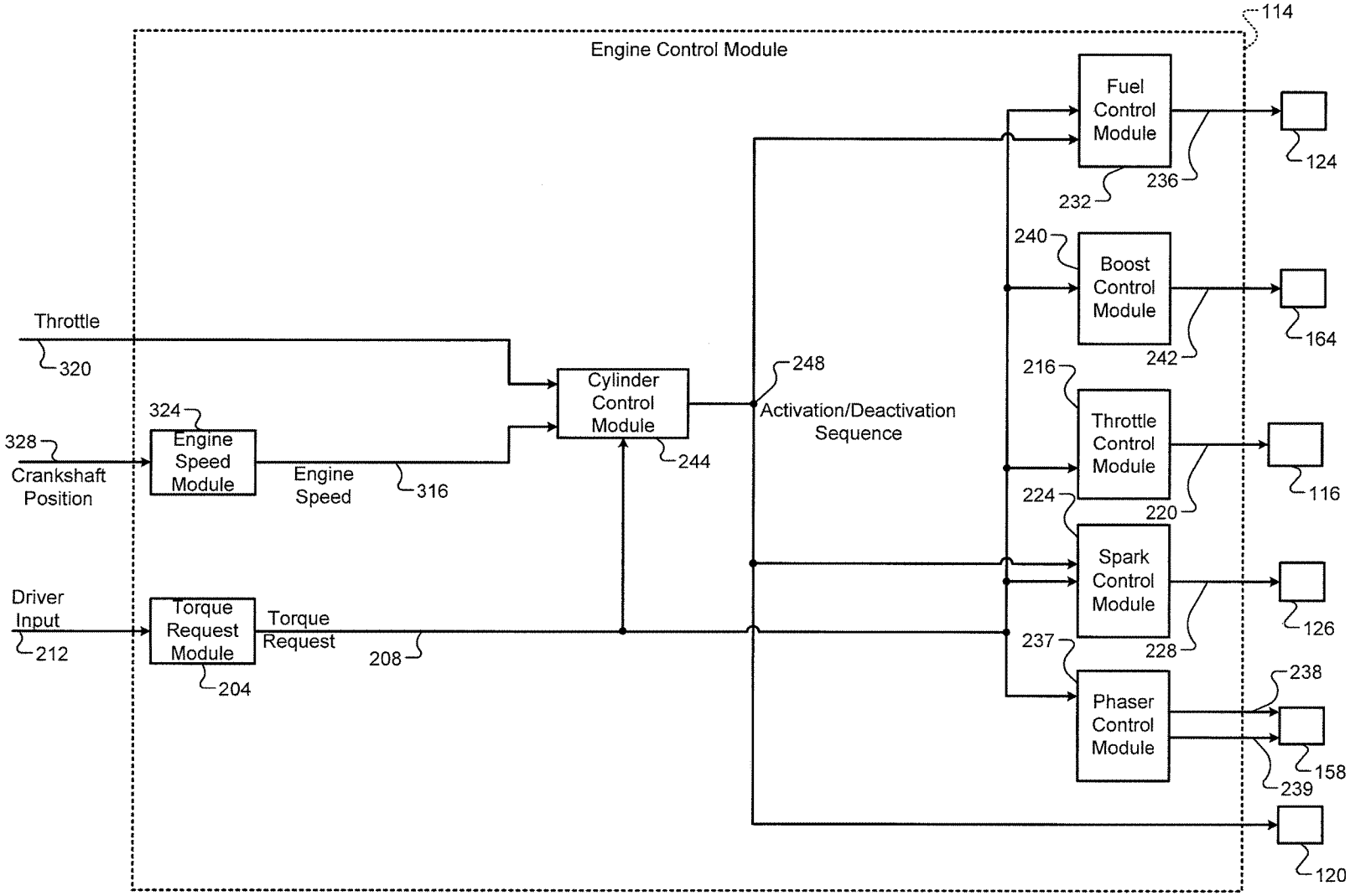
FIG. 2 is a functional block diagram of an example engine control system according to the present disclosure.

Referring now to FIG. 2, a functional block diagram of an example engine control system is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators may be controlled based on the torque request 208 and/or one or more other parameters. For example, a throttle control module 216 may determine a target throttle opening 220 based on the torque request 208. The throttle actuator module 116 may adjust opening of the throttle valve 112 based on the target throttle opening 220.

A spark control module 224 may determine a target spark timing 228 based on the torque request 208. The spark actuator module 126 may generate spark based on the target spark timing 228. A fuel control module 232 may determine one or more target fueling parameters 236 based on the torque request 208. For example, the target fueling parameters 236 may include fuel injection amount, number of fuel injections for injecting the amount, and timing for each of the injections. The fuel actuator module 124 may inject fuel based on the target fueling parameters 236.

A phaser control module 237 may determine target intake and exhaust cam phaser angles 238 and 239 based on the torque request 208. The phaser actuator module 158 may regulate the intake and exhaust cam phasers 148 and 150 based on the target intake and exhaust cam phaser angles 238 and 239, respectively. A boost control module 240 may determine a target boost 242 based on the torque request 208. The boost actuator module 164 may control boost output by the boost device(s) based on the target boost 242.

A cylinder control module 244 (see also FIG. 3) determines a target cylinder activation/deactivation sequence 248 based on the torque request 208. The cylinder actuator module 120 deactivates the intake and exhaust valves of the cylinders that are to be deactivated according to the target cylinder activation/deactivation sequence 248. The cylinder actuator module 120 allows opening and closing of the intake and exhaust valves of cylinders that are to be activated according to the target cylinder activation/deactivation sequence 248.

Fueling is halted (zero fueling) to cylinders that are to be deactivated according to the target cylinder activation/deactivation sequence 248, and fuel is provided the cylinders that are to be activated according to the target cylinder activation/deactivation sequence 248. Spark is provided to the cylinders that are to be activated according to the target cylinder activation/deactivation sequence 248. Spark may be provided or halted to cylinders that are to be deactivated according to the target cylinder activation/deactivation sequence 248. Cylinder deactivation is different than fuel cutoff (e.g., deceleration fuel cutoff) in that the intake and exhaust valves of cylinders to which fueling is halted during fuel cutoff are still opened and closed during the fuel cutoff whereas the intake and exhaust valves are maintained closed when deactivated.

Figure 3:
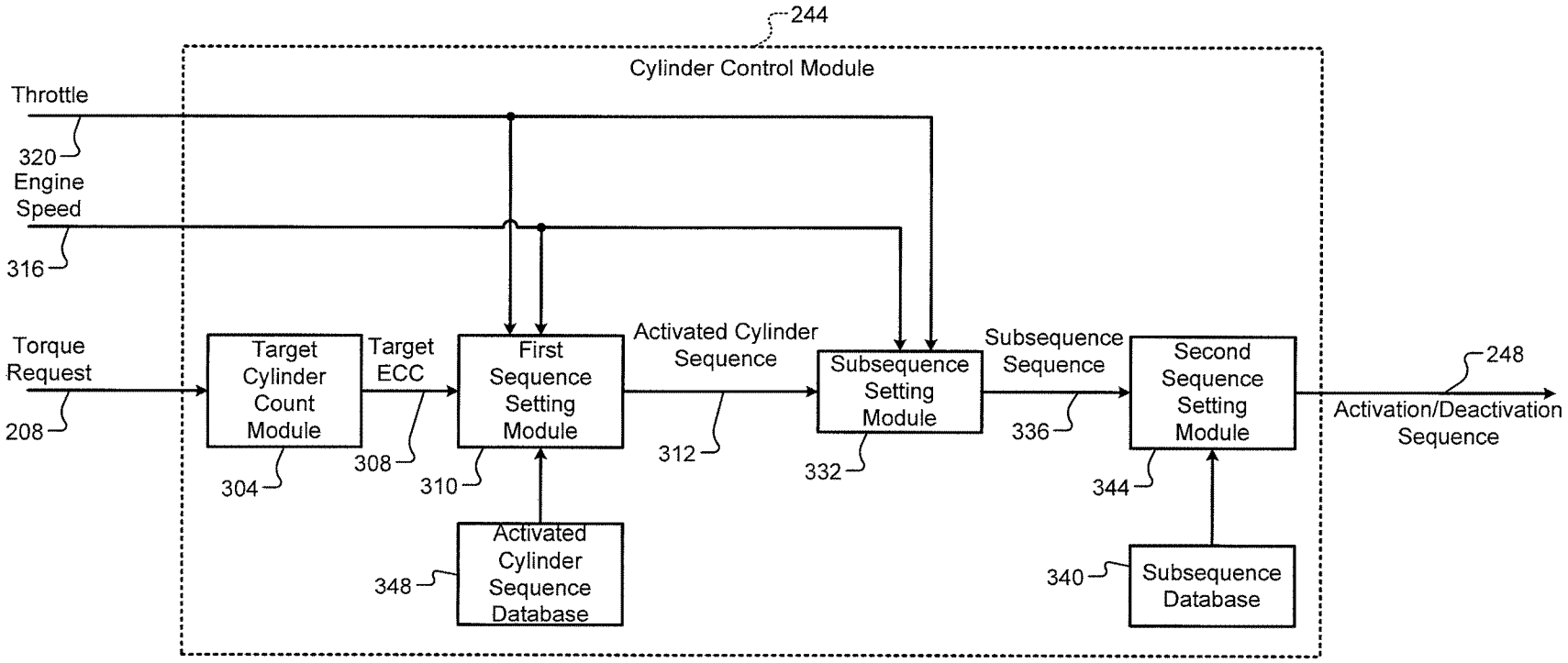
FIG. 3 is a functional block diagram of an example cylinder control module according to the present disclosure.

Referring now to FIG. 3, a functional block diagram of an example implementation of the cylinder control module 244 is presented. A target cylinder count module 304 generates a target effective cylinder count (ECC) 308. The target ECC 308 corresponds to a target number of cylinders to be activated (i.e., fired) per engine cycle on average over the next P engine cycles (corresponding to the next M possible cylinder events in a predetermined firing order of the cylinders). Where P is an integer greater than or equal to two. One engine cycle may refer to the period for each of the cylinders of the engine 102 to accomplish one combustion cycle. For example, in a four-stroke engine, one engine cycle may correspond to two crankshaft revolutions.

The target ECC 308 may be an integer or a non-integer that is between zero and the total number of possible cylinder events per engine cycle, inclusive. Cylinder events include cylinder firing events and events where deactivated cylinders would, if activated, be fired. While the example where P is equal to 10 is discussed below, P is an integer greater than or equal to two. While engine cycles and the next P engine cycles will be discussed, another suitable period (e.g., the next N sets of X number of cylinder events) may be used.

The target cylinder count module 304 generates the target ECC 308 based on the torque request 208. The target cylinder count module 304 may determine the target ECC 308, for example, using a function or a mapping that relates the torque request 208 to the target ECC 308. For example only, for a torque request that is approximately 50% of a maximum torque output of the engine 102 under the operating conditions, the target ECC 308 may be a value corresponding to approximately half of the total number of cylinders of the engine 102. The target cylinder count module 304 may generate the target ECC 308 further based on one or more other parameters, such as one or more loads on the engine 102 and/or one or more other suitable parameters.

In some implementations, the target cylinder count module 304 determines whether the torque request 208 is within one of a plurality of predetermined torque request ranges. For example, a first torque request range includes a first lower torque value and a first upper torque value. The target cylinder count module 304 determines whether the torque request 208 is between the first lower torque value and the first upper torque value (i.e., greater than the first lower torque value and less than the first upper torque value). When the target cylinder count module 304 determines the torque request value is between the first lower torque value and the first upper torque value, the target cylinder count module 304 determines the target ECC 308 corresponding to the first torque request range.

It is understood that each of the plurality of torque request ranges may correspond to a target ECC. For example, the first torque request range corresponds to a first target ECC, while a second torque request range corresponds to a second target ECC. During a calibration phase of the vehicle, torque request ranges are identified corresponding to various operating parameters of the vehicle. Similarly, target ECCs corresponding to each torque request range are identified. The target cylinder count module 304 determines a torque request range that the torque request 208 falls within. The target cylinder count module 304 determines the target ECC that corresponds to the torque request range and sets the target ECC 308 equal to the target ECC corresponding to the torque request range. In this manner, the torque request 208 may vary within a range of values while the target ECC 308 remains steady.

A first sequence setting module 310 generates an activated cylinder sequence 312 to achieve the target ECC 308 over the next P engine cycles. The first sequence setting module 310 may determine the activated cylinder sequence 312, for example, using a mapping that relates the target ECC 308 to the activated cylinder sequence 312.

The activated cylinder sequence 312 includes a sequence of integers that correspond to the number of cylinders that should be activated during the next P engine cycles, respectively. In this manner, the activated cylinder sequence 312 indicates how many cylinders should be activated during each of the next P engine cycles. For example, the activated cylinder sequence 312 may include an array including P integers for the next P engine cycles, respectively, such as:

$[I_1, I_2, I_3, I_4, I_5, I_6, I_7, I_8, I_9, I_{10}]$, where P is equal to 10, $I_1$ is an integer number of cylinders to be activated during the first one of the next 10 engine cycles, $I_2$ is an integer number of cylinders to be activated during the second one of the next N engine cycles, $I_3$ is an integer number of cylinders to be activated during the third one of the next N engine cycles, and so on.

When the target ECC 308 is an integer, that number of cylinders can be activated during each of the next P engine cycles to achieve the target ECC 308. For example only, if the target ECC 308 is equal to 4, 4 cylinders can be activated per engine cycle to achieve the target ECC 308 of 4. An example of the activated cylinder sequence 312 for activating 4 cylinders per engine cycle during the next P engine cycles is provided below where P is equal to 10.

[4, 4, 4, 4, 4, 4, 4, 4, 4, 4].

Different numbers of activated cylinders per engine cycle can also be used to achieve the target ECC 308 when the target ECC 308 is an integer. For example only, if the target ECC 308 is equal to 4, 4 cylinders can be activated during one engine cycle, 3 cylinders can be activated during another engine cycle, and 5 cylinders can be activated during another engine cycle to achieve the target ECC 308 of 4. An example of the activated cylinder sequence 312 for activating one or more different numbers of activated cylinders is provided below where P is equal to 10.

[4, 5, 3, 4, 3, 5, 3, 5, 4, 4].

When the target ECC 308 is a non-integer, different numbers of activated cylinders per engine cycle are used to achieve the target ECC 308. For example only, if the target ECC 308 is equal to 5.4, the following example activated cylinder sequence 312 can be used to achieve the target ECC 308:

[5, 6, 5, 6, 5, 6, 5, 5, 6, 5]

where P is equal to 10, 5 indicates that 5 cylinders are activated during the corresponding ones of the next 10 engine cycles, and 6 indicates that 6 cylinders are activated during the corresponding ones of the next 10 engine cycles. While use of the two nearest integers to a non-integer value of the target ECC 308 have been discussed as examples, other integers may be used additionally or alternatively.

The first sequence setting module 310 may update or select the activated cylinder sequence 312 based on one or more other parameters, such as engine speed 316 and/or a throttle opening 320. For example only, the first sequence setting module 310 may update or select the activated cylinder sequence 312 such that greater numbers of activated cylinders are used near the end of the next P engine cycles (and lesser numbers of activated cylinders are used near the beginning of the next P engine cycles) when the engine speed 316 and/or the throttle opening 320 is increasing. This may provide for a smoother transition to an increase in the target ECC 308. The opposite may be true when the engine speed 316 and/or the throttle opening 320 is decreasing.

An engine speed module 324 (FIG. 2) may generate the engine speed 316 based on a crankshaft position 328 measured using the crankshaft position sensor 180. The throttle opening 320 may be generated based on measurements from one or more of the throttle position sensors 190.

A subsequence setting module 332 sets a sequence of subsequences 336 based on the activated cylinder sequence 312 and the engine speed 316. The sequence of subsequences 336 includes N indicators of N predetermined cylinder activation/deactivation subsequences to be used to achieve the corresponding numbers of activated cylinders (indicated by the activated cylinder sequence 312) during the next P engine cycles, respectively. The subsequence setting module 332 may set the sequence of subsequences 336, for example, using a mapping that relates the engine speed 316 and the activated cylinder sequence 312 to the sequence of subsequences 336.

Statistically speaking, one or more possible cylinder activation/deactivation subsequences are associated with each possible number of activated cylinders per engine cycle. A unique indicator may be associated with each of the possible cylinder activation/deactivation subsequences for achieving a given number of activated cylinders. The following tables include example indicators and possible subsequences for 5 and 6 active cylinders per engine cycle with 8 cylinder events per engine cycle:

| 5 Cylinders Firing | | 6 Cylinders Firing | |
|---|---|---|---|
| Unique indicator | Subsequence | Unique indicator | Subsequence |
| 5_01 | 00011111 | 6_01 | 00111111 |
| 5_02 | 00101111 | 6_02 | 01011111 |
| . | . | . | . |
| . | . | . | . |
| . | . | . | . |
| 5_10 | 01011101 | 6_10 | 10110111 |
| 5_11 | 01011110 | 6_11 | 10111011 |
| . | . | . | . |
| . | . | . | . |
| . | . | . | . |
| 5_28 | 10101011 | 6_28 | 11111100 |
| . | . | | |
| . | . | | |
| . | . | | |
| 5_56 | 11111000 | | |

where a 1 in a subsequence indicates that the corresponding cylinder in the firing order should be activated and a 0 indicates that the corresponding cylinder should be deactivated. While only possible subsequences for 5 and 6 active cylinders per engine cycle are provided above, one or more possible cylinder activation/deactivation subsequences are also associated with each other number of active cylinders per engine cycle.

In another implementation, subsequences having different lengths and/or subsequences with lengths that are different than the number of cylinder events per engine cycle can be used. In order to maintain a pressure within the intake manifold 110, a subsequence may transition from activating another predetermined number of cylinders in a first number of cylinder events to activating a predetermined number of cylinders in a second number of cylinder events. For example, the subsequence may transition from activating 3 cylinders out of a potential of 8 cylinder events to activating 3 cylinders out of a potential of 7 cylinder events. The following tables include example indicators and possible subsequences for 3 active cylinders out of a potential of 8 cylinder events per engine cycle and 3 active cylinders out of a potential of 7 cylinder events per subsequence:

| 3 Cylinders Firing 8 Potential | | 3 Cylinders Firing 7 Potential | |
|---|---|---|---|
| Unique indicator | Subsequence | Unique indicator | Subsequence |
| 3_8_01 | 00100101 | 3_7_01 | 0010101 |
| 3_8_02 | 00100110 | 3_7_02 | 0010110 |
| . | . | . | . |
| . | . | . | . |
| . | . | . | . |
| 3_8_10 | 01100010 | 3_7_10 | 0011001 |
| 3_8_11 | 01101000 | 3_7_11 | 0100101 |
| . | . | . | . |
| . | . | . | . |
| . | . | . | . |
| 3_8_28 | 10101000 | 3_7_28 | 1000101 |
| . | . | | |
| . | . | | |
| . | . | | |
| 3_8_56 | 11100000 | | |

While only possible subsequences for 3 out of 8 active cylinders and 3 out of 7 active cylinders per engine cycle are provided above, one or more possible cylinder activation/deactivation subsequences are also associated with each other number of active cylinders during each of the M cylinder events per engine cycle.

During a calibration phase of vehicle design, possible subsequences and sequences of the possible sequences producing minimum levels of vibration, minimum induction and exhaust noise, desired vibration characteristics, more even torque production/delivery, and better linkability with other possible subsequences are identified for various engine speeds. The identified subsequences are stored as predetermined cylinder activation/deactivation subsequences in a subsequence database 340.

Further, transition parameters between the subsequences may be identified and stored in the subsequence database 340. The transition parameters may indicate whether to truncate an outgoing subsequence and and/or to delay the start of an incoming subsequence. It is understood the outgoing subsequence may be repeated a plurality of times prior to transitioning to the incoming subsequence. The transition patterns may include a first value and a second value. The first value indicates whether to truncate an outgoing subsequence. For example, when the first value is greater than 0, the outgoing subsequence is truncated by the value of the first value. The second value indicates whether to delay the start of an incoming subsequence. For example, when the second value is greater than 0, the incoming subsequence is delayed by the value of the second value. By way of non-limiting example, a first transition pattern may be [2,5]. The outgoing subsequence is truncated by 2. In other words, the last 2 values of the outgoing subsequence are removed. The incoming subsequence is delayed by 5. In other words, the first 5 values of the incoming subsequence are removed. The outgoing subsequence and the incoming subsequence are then combined into an adjusted subsequence.

The transition parameters may be based on a length of the outgoing subsequence, a length of the incoming subsequence, an engine speed, a selected transmission gear, engine torque level, and other vehicle characteristics and operating conditions. During transition between an outgoing subsequence and an incoming subsequence, a driver and/or passenger within the vehicle may feel a vibration and/or a bump. This may be caused by a transition between subsequences of different lengths. The transition parameters truncate and/or delay the subsequences in order to reduce or remove the vibration and/or bump as felt by the driver and/or passenger.

For example, a first engine speed, a first subsequence may be selected in order to achieve a first cylinder firing pattern. As the engine speed changes, a second subsequence may be selected to achieve a second cylinder firing pattern. It is understood the first subsequence may be repeated a plurality of times prior to transitioning to the second subsequence. Transition parameters are identified that may effectively reduce or remove the vibration as a result of a transition between subsequences. In some instances, the first and second subsequence may be different sequence length. For example, the first subsequence may be a 3 out of 8 pattern. In other words, 3 cylinders are active out of 8 possible firing events. The second subsequence may be a 3 out of 7 pattern. In other words, 3 cylinders are active out of 7 possible firing events.

A transition pattern of [2,5] may effectively reduce or remove the vibration and/or bump as felt by the driver and/or passenger. Applying the transition pattern would truncate the 3 out of 8 firing pattern by 2 possible firing events and delay the start of the 3 out of 7 firing pattern by 5 possible firing events. The resulting adjusted sequence would include 8 possible firing events.

During the calibration phase of the vehicle design, all possible transitions between all identified possible subsequences are identified. Transition parameters associated with each possible transition may be identified and stored in the subsequence database 340.

During vehicle operation, the subsequence setting module 332 sets the sequence of subsequences 336 based on the activated cylinder sequence 312 and the engine speed 316. An example of the sequence of subsequences 336 for the example activated cylinder sequence of [5, 6, 5, 6, 5, 6, 5, 5, 6, 5] is:

[5_23, 6_25, 5_19, 6_22, 5_55, 6_01, 5_23, 5_21, 6_11, 5_29], where 5_23 is the indicator of one of the predetermined cylinder activation/deactivation subsequences that is to be used to activate 5 cylinders during the first one of the next P engine cycles, where 6_25 is the indicator of one of the predetermined cylinder activation/deactivation subsequences that is to be used to activate 6 cylinders during the second one of the next P engine cycles, 5_19 is the indicator of one of the predetermined cylinder activation/deactivation subsequences that is to be used to activate 5 cylinders during the third one of the next P engine cycles, 6_22 is the indicator of one of the predetermined cylinder activation/deactivation subsequences that is to be used to activate 6 cylinders during the fourth one of the next P engine cycles, and so on.

In another implementation, the subsequence setting module 332 determines whether to adjust one or more predetermined cylinder activation/deactivation subsequences. For example, the subsequence 336 may include a subsequence pair comprising a first subsequence and second subsequence. The first and second subsequences may be of different subsequence lengths. Transitioning between subsequences of different lengths may be felt as a vibration and/or a bump to a driver or a passenger of the vehicle. In order to produce an acceptable transient vibration, the subsequence setting module 332 may selectively adjust one or more predetermined cylinder activation/deactivation subsequences.

For example, the subsequence setting module 332 sets the sequence of subsequences 336 based on the activated cylinder sequence 312 and the engine speed 316. The second subsequence immediately follows the first subsequence. However, it is noted that while the identifiers first and second are used, the subsequence pair may occur anywhere within the subsequence 336. Further, the first subsequence may be repeated multiple times prior to transitioning to the second subsequence. By repeating a subsequence the vehicle experiences less transient vibration. Further, an average target ECC per engine cycle may be when the target ECC 304 is a non-integer value. For example, as described above, the target ECC is the average number of cylinder firings per engine cycle.

A subsequence may have a subsequence length X. A sequence may repeat the subsequence Y times and include Z potential firing events, where Z=X*Y. By way of non-limiting example only, a subsequence may fire 4 cylinders out of every 7 potential firing events, the sequence repeats the subsequence 8 times, resulting in 56 potential firing events during the sequence. During the sequence, 32 cylinder firings occur of the potential 56 (i.e., 4 of every 7, or 4*8 out of 7*8). The ECC is equal to the number of cylinders that fire per engine cycle, on average, during the sequence. In the example, assuming the vehicle includes 8 cylinders, 56 firing events occurs every 7 engine cycles (i.e., Z divided by the number of cylinders). The ECC would be equal to 32 cylinder firings divided by 7 engine cycles, or 4.57 effective cylinders fired every engine cycle.

The subsequence setting module 332 may determine a transition parameter associated with a transition between the first and second subsequences. As described above, the transition parameter is stored in subsequence database 340. The subsequence setting module 332 determines a transition parameter associated with the transition between the first and second subsequences. The subsequence setting module 332 selectively adjusts the first and second subsequence based on the transition parameter.

As described above, a subsequence may transition from activating a predetermined number of cylinders in a first number of cylinder events to activating another predetermined number of cylinders in a second number of cylinder events. For example, the subsequence may transition from activating 3 cylinders out of a potential of 8 cylinder events to activating 3 cylinders out of 7 cylinder events.

The subsequence setting module 332 sets the sequence of subsequences 336 based on the activated cylinder sequence 312 and the engine speed 316. An example of the sequence of subsequences 336 for an example activated cylinder sequence is:

[3_8_01, 3_8_01, 3_8_01, 3_8_01, 3_7_01, 3_7_01, 37_01, 3_7_01, 37_01, 3_7_01], where 3_8_01 is the indicator of one of the predetermined cylinder activation/deactivation subsequences that is to be used to activate 3 cylinders during 8 potential cylinder events during a first sequence of the next P engine cycles and where 3_7_01 is the indicator of one of the predetermined cylinder activation/deactivation subsequences that is to be used to activate 3 cylinders during 7 potential cylinder events during a second sequence of the next P engine cycles.

In the example above, the subsequence 336 includes a sequence pair that includes a first subsequence (3_8_01) and a second subsequence (3_7_01) that are of different subsequence lengths. For example, 3_8_01 has a subsequence of 00100101 (i.e., a length of 8) and 3_7_01 has a subsequence of 0010101 (i.e., a length of 7). The transition between these subsequences would be to join them as 00100101:0010101. This transition may be felt as a vibration and/or a bump to the driver and/or a passenger of the vehicle. The subsequence setting module 332 selectively adjusts one or both of the subsequences based on the transition parameter associated to a transition between the 3_8_01 subsequence and the 3_7_01 subsequence.

In the example above, the transition parameter for the transition between the 3_8_01 subsequence and the 3_7_01 subsequence may be [2,3]. The transition parameter is a predetermined parameter. During calibration of the vehicle, transition parameters are identified for each possible transition between each possible subsequence pairs. In other words, each possible outgoing subsequence includes a transition into each possible incoming subsequence. A transition parameter that reduces and/or removes the vibration during the transition, for the given operating conditions, is identified and stored in the database 340.

The subsequence setting module 332 selectively adjusts the 3_8_01 subsequence and the 3_7_01 subsequence based on the [2,3] transition parameter. For example, the subsequence setting module 332 adjusts the 3_8_01 subsequence from 00100101 to 001001 (i.e., eliminating the last two events) and adjusts the 3_7_01 subsequence from 0010101 to 0101 (i.e., eliminating the first three events).

The resulting transition would be an adjusted subsequence of 001001:0101. The adjusted subsequence may provide less transient vibration than the original transition between the 3_8_01 subsequence and the 3_7_01 subsequence. Further, the resulting subsequence activates 4 cylinders out of 10 cylinder events (i.e., 40%). Whereas the 3_8_01 subsequence activates 3 cylinders out of 8 cylinder events (i.e., 37.5%) and the 3_7_01 subsequence activates 3 cylinders out of 7 cylinder events (i.e., 42.9%). By applying the transition parameter, the resulting transition produces an output torque between the 3_8_01 subsequence and the 3_7_01 subsequence, resulting in a more gradual increase in output torque. The subsequence setting module 332 replaces the first subsequence (3_8_01) and the second subsequence (3_7_01) with the adjusted subsequence within the sequence of subsequences 336. In this manner, the subsequence setting module 332 identifies transitions that may result in a vibration and/or bump and selective applies a transition parameter in order to reduce or remove the vibration and/or bump from the sequence of subsequences 336.

A second sequence setting module 344 receives the sequence of subsequences 336 and generates the target cylinder activation/deactivation sequence 248. More specifically, the second sequence setting module 344 sets the target cylinder activation/deactivation sequence 248 to the predetermined cylinder activation/deactivation subsequences indicated in the sequence of subsequences 336, in the order specified in the sequence of subsequences 336. The second sequence setting module 344 retrieves the predetermined cylinder activation/deactivation subsequences indicated from the subsequence database 340 and the adjusted subsequence. It is understood that the sequence of subsequences 336 may include one or more adjusted subsequences. Further, the sequence of subsequences 336 may not include any adjusted subsequences. The cylinders are activated according to the target cylinder activation/deactivation sequence 248 during the next N engine cycles.

It may be desirable to vary the activated cylinder sequence 312 from one set of P engine cycles to another set of P engine cycles. This variation may be performed, for example, to prevent harmonic vibration from being experienced within a passenger cabin of the vehicle or to maintain a random vibration characteristic. For example, two or more predetermined activated cylinder sequences may be stored in an activated cylinder sequence database 348 for a given target ECC, and predetermined percentages of use may be provided for each of the predetermined activated cylinder sequences. If the target ECC 308 remains approximately constant, the first sequence setting module 310 may select the predetermined activated cylinder sequences for use as the activated cylinder sequence 312 in an order based on the predetermined percentages.

Figure 4:
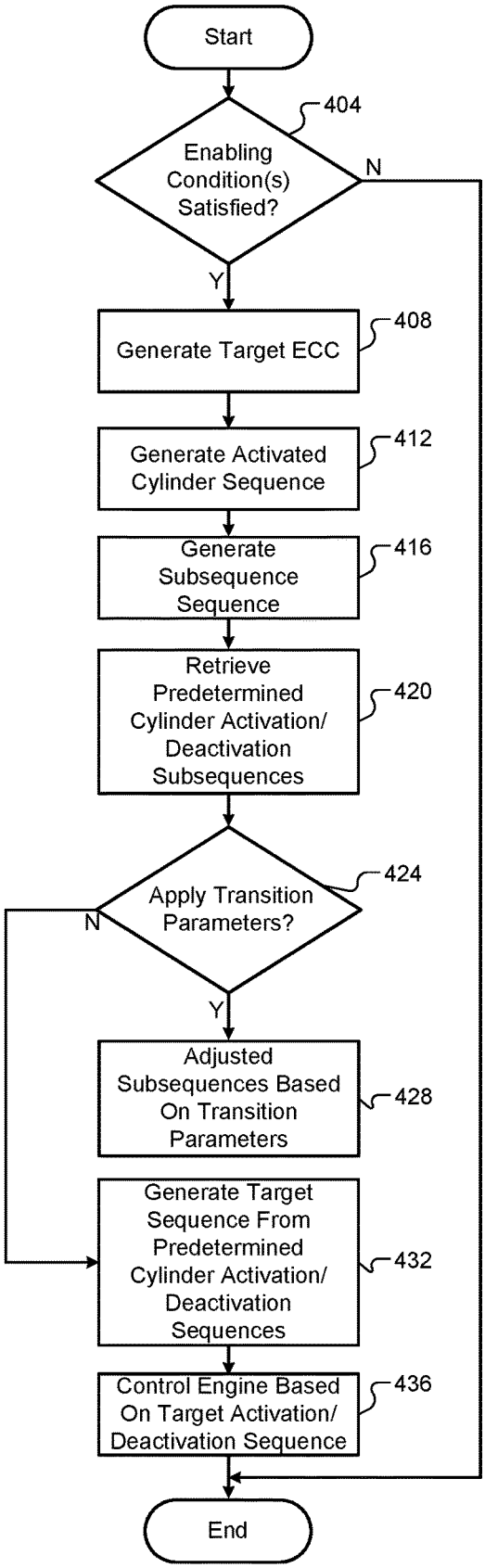
FIG. 4 is a flowchart depicting an example method of controlling cylinder activation and deactivation according to the present disclosure.

Referring now to FIG. 4, a flowchart depicting an example method of controlling cylinder activation and deactivation is presented. At 404, the cylinder control module 244 determines whether one or more enabling conditions are satisfied. For example, the cylinder control module 244 determines whether a steady-state or quasi steady-state operating condition is occurring at 404. If true, control continues at 408. If false, control ends. A steady-state or a quasi steady-state operating condition may be said to be occurring, for example, when the engine speed 316 has changed by less than a predetermined amount (e.g., approximately 100-200 RPM) over a predetermined period (e.g., approximately 5 seconds). Additionally or alternatively, the throttle opening 320 and/or one or more other suitable parameters may be used to determine whether a steady-state or a quasi steady-state operating condition is occurring.

At 408, the target cylinder count module 304 generates the target ECC 308. The target cylinder count module 304 determines the target ECC 308 based on the torque request 208 and/or one or more other parameters, as discussed above. The target ECC 308 corresponds to a target number of cylinders to be activated per engine cycle on average over the next P engine cycles.

The first sequence setting module 310 generates the activated cylinder sequence 312 at 412. The first sequence setting module 310 determines the activated cylinder sequence 312 based on the target ECC 308 and/or one or more other parameters, as discussed above. The activated cylinder sequence 312 includes a sequence of N integers that correspond to the number of cylinders that should be activated during the next P engine cycles, respectively.

The subsequence setting module 332 generates the sequence of subsequences 336 at 416. The subsequence setting module 332 determines the sequence of subsequences 336 based on the activated cylinder sequence 312, the engine speed 316, and/or one or more other parameters, as discussed above. The sequence of subsequences 336 includes N indicators of N predetermined cylinder activation/deactivation subsequences to be used to achieve the corresponding numbers of activated cylinders indicated by the activated cylinder sequence 312.

At 420, the second sequence setting module 344 retrieves the predetermined cylinder activation/deactivation subsequences indicated by the sequence of subsequences 336. The second sequence setting module 344 retrieves the predetermined cylinder activation/deactivation subsequences from the subsequence database 340. Each of the predetermined cylinder activation/deactivation subsequences includes a sequence for activating and deactivating cylinders during one of the next P engine cycles.

At 424, the subsequence setting module 332 identifies transitions between each of the retrieved, predetermined cylinder activation/deactivation subsequences. The subsequence setting module 332 determines whether to apply a transition parameter based on a determination of whether a transition has an associated transition parameter. For example, a transition may be associated with an outgoing subsequence and an incoming subsequence. The outgoing subsequence and the incoming subsequence may be of different sequence lengths. The transition between the outgoing subsequence and incoming subsequence (of different lengths) may result in a vibration and/or bump as felt by a driver or passenger within the vehicle. A transition parameter may be associated with the transition.

The transition parameter reduces and/or removes the vibration and/or bump. Further, the outgoing subsequence and the incoming subsequence may be of the same sequence length. The transition between the outgoing and incoming subsequence may include an associated transition parameter. In other words, transitioning sequences of different lengths as well as transition sequences of the same length may result in a vibration and/or bump (i.e., depending on the particular subsequences being transitioned).

If true, control continues at 428. If false, control continues at 432. At 428, the subsequence setting module 332 selectively applies a transition parameter to at least one of the outgoing subsequence and the incoming subsequence based on the transition parameter. The subsequence setting module 332 communicates the adjusted subsequences to the second sequence setting module 344. Additionally or alternatively, the subsequence setting module 332 removes the outgoing subsequence and/or the incoming subsequence. The subsequence setting module 332 includes the at least one adjusted subsequence within the sequence of subsequences 336.

At 432, the second sequence setting module 344 generates the target cylinder activation/deactivation sequence 248 based on the retrieved, predetermined cylinder activation/deactivation subsequences. Further, the second sequence setting module 344 may determine whether the sequence setting module 332 adjusted one or more subsequences. When the second sequence setting module 334 determines the sequencer setting module 332 adjusted at least one subsequence, the second sequence setting module 344 includes the at least one adjusted subsequence in the target cylinder activation/deactivation sequence 248.

More specifically, the second sequence setting module 344 assembles the retrieved, predetermined cylinder activation/deactivation sequences, in the order indicated by the sequence of subsequences 336, to generate the target cylinder activation/deactivation sequence 248. In this manner, the target cylinder activation/deactivation sequence 248 includes a sequence for activating and deactivating cylinders during the next N engine cycles.

The engine 102 is controlled based on the target cylinder activation/deactivation sequence 248 at 436. For example, if the target cylinder activation/deactivation sequence 248 indicates that the next cylinder in the firing order should be activated, the following cylinder in the firing order should be deactivated, and the following cylinder in the firing order should be activated, then the next cylinder in the predetermined firing order is activated, the following cylinder in the predetermined firing order is deactivated, and the following cylinder in the predetermined firing order is activated.

The cylinder control module 244 deactivates opening of the intake and exhaust valves of cylinders that are to be deactivated. The cylinder control module 244 allows opening and closing of the intake and exhaust valves of cylinders that are to be activated. The fuel control module 232 provides fuel to cylinders that are to be activated and halts fueling to cylinders that are to be deactivated. The spark control module 224 provides spark to cylinders that are to be activated. The spark control module 224 halts spark or provides spark to cylinders that are to be deactivated. While control is shown as ending, FIG. 4 is illustrative of one control loop, and a control loop may be executed, for example, every predetermined amount of crankshaft rotation.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A cylinder control system of a vehicle, comprising:

a cylinder control module that:

determines target numbers of cylinders of an engine to be activated during a period;

determines, based on the target numbers and an engine speed, N predetermined subsequences for controlling the cylinders of the engine during the period, where N is an integer greater than zero;

determines a transition parameter associated with at least one transition between two of the N predetermined subsequences, the two predetermined subsequences each including M indicators for the M cylinder events, each of the M indicators indicating whether to activate or deactivate a corresponding cylinder, where M is an integer greater than one, wherein the transition parameter includes a first number (X) for truncating one of the two predetermined subsequences and a second number (Y) for truncating the other one of the two predetermined subsequences, where X and Y are integers greater than zero and less than M;

adjusts the one of the two predetermined subsequences, by removing the last X number of the M indicators of the one of the two predetermined subsequences, to produce a first adjusted predetermined subsequence; and adjusts the other one of the two predetermined subsequences, by removing the first Y number of the M indicators of the other one of the two predetermined subsequences, to produce a second adjusted predetermined subsequence; and a cylinder actuator module that, during the period, controls the cylinders of the engine based on the N predetermined subsequences, the first adjusted predetermined subsequence, and the second adjusted predetermined subsequence.

2. The cylinder control system of claim 1 wherein the cylinder control module determines the target numbers of cylinders to be activated during the period based on an engine torque request.

3. The cylinder control system of claim 1 wherein the cylinder control module generates a target sequence for activating and deactivating cylinders of the engine based on the N predetermined subsequences, the first adjusted predetermined subsequence, and the second adjusted predetermined subsequence.

4. The cylinder control system of claim 3 wherein the cylinder actuator module activates opening of intake and exhaust valves of first ones of the cylinders that are to be activated based on the N predetermined subsequences, the first adjusted predetermined subsequence, and the second adjusted predetermined subsequence and deactivates opening intake and exhaust valves of second ones of the cylinders that are to be deactivated based on the N predetermined subsequences, the first adjusted predetermined subsequence, and the second adjusted predetermined subsequence.

5. The cylinder control system of claim 1 wherein the cylinder control module retrieves the transition parameter associated with the at least one transition between the at least two of the N predetermined subsequences.

6. The cylinder control system of claim 1 wherein the cylinder control module adjusts the one of the two predetermined subsequences based on a determination that the first number X of the transition parameter is greater than 0.

7. The cylinder control system of claim 6 wherein the cylinder control module adjusts the other one of the two predetermined subsequences based on a determination that the second number Y of the transition parameter is greater than 0.

8. A cylinder control method of a vehicle, comprising:

determining target numbers of cylinders of an engine to be activated during a period, determining, based on the target numbers and an engine speed, N predetermined subsequences for controlling cylinders of the engine during the period, where N is an integer greater than zero;

determining a transition parameter associated with at least one transition between two of the N predetermined subsequences, the two predetermined subsequences each including M indicators for the M cylinder events, each of the M indicators indicating whether to activate or deactivate a corresponding cylinder, where M is an integer greater than one, wherein the transition parameter includes a first number (X) for truncating one of the two predetermined subsequences and a second number (Y) for truncating the other one of the two predetermined subsequences, where X and Y are integers greater than zero and less than M;

adjusting the one of the two predetermined subsequences, by removing the last X number of the M indicators of the one of the two predetermined subsequences, to produce a first adjusted predetermined subsequence;

adjusting the other one of the two predetermined subsequences, by removing the first Y number of the M indicators of the other one of the two predetermined subsequences, to produce a second adjusted predetermined subsequence; and controlling, during the period, the cylinders of the engine based on the N predetermined subsequences, the first adjusted predetermined subsequence, and the second adjusted predetermined subsequence.

9. The cylinder control method of claim 8 further comprising, determining the target numbers of cylinders to be activated during the period based on an engine torque request.

10. The cylinder control method of claim 8 further comprising generating a target sequence for activating and deactivating cylinders of the engine based on the N predetermined subsequences, the first adjusted predetermined subsequence, and the second adjusted predetermined subsequence.

11. The cylinder control method of claim 10 further comprising activating opening of intake and exhaust valves of first ones of the cylinders that are to be activated based on the N predetermined subsequences, the first adjusted predetermined subsequence, and the second adjusted predetermined subsequence and deactivating opening of intake and exhaust valves of second ones of the cylinders that are to be deactivated based on the N predetermined subsequences, the first adjusted predetermined subsequence, and the second adjusted predetermined subsequence.

12. The cylinder control method of claim 8 further comprising retrieving the transition parameter associated with the at least one transition between the at least two of the N predetermined subsequences.

13. The cylinder control method of claim 8 wherein the adjusting the one of the two predetermined subsequences includes adjusting the one of the two predetermined subsequences based on a determination that the first number X of the transition parameter is greater than 0.

14. The cylinder control method of claim 13 wherein the adjusting the other one of the two predetermined subsequences includes adjusting the other one of the two predetermined subsequences based on a determination that the second number Y of the transition parameter is greater than 0.

* * * * *